US006941610B2

(12) United States Patent
Reed, Jr.

(10) Patent No.: US 6,941,610 B2
(45) Date of Patent: Sep. 13, 2005

(54) GUTTER SWEEP

(76) Inventor: Cam Reed, Jr., 14426 Lourdes Dr., Houston, TX (US) 77049

( * ) Notice: Subject to any disclaimer, the term of this patent is extended or adjusted under 35 U.S.C. 154(b) by 108 days.

(21) Appl. No.: 09/964,312

(22) Filed: Sep. 26, 2001

(65) Prior Publication Data

US 2002/0042961 A1 Apr. 18, 2002

(51) Int. Cl.[7] ..... A47L 13/02; A46B 15/00

(52) U.S. Cl. ..... 15/236.04; 15/160; 15/145; 294/55

(58) Field of Search ..... 15/1, 59.1, 160, 15/236.04, 145, 146, 144.1, 144.3; 294/19.1, 55

(56) References Cited

U.S. PATENT DOCUMENTS

| | | | | | |
|---|---|---|---|---|---|
| 2,677,840 | A | * | 5/1954 | Morton | 15/160 |
| 4,298,224 | A | | 11/1981 | Hansen et al. | |
| 4,310,940 | A | | 1/1982 | Moore | |
| 4,447,927 | A | | 5/1984 | Malless, Jr. | |
| 4,640,540 | A | * | 2/1987 | Chisholm | 294/55 |
| 4,848,818 | A | * | 7/1989 | Smith | 294/19.1 |
| 5,288,118 | A | | 2/1994 | Hartselle, III | |
| 5,435,612 | A | | 7/1995 | Kreiser | |
| 5,626,377 | A | | 5/1997 | Carroll, Jr. et al. | |
| 5,853,209 | A | * | 12/1998 | McDermott | 294/19.1 |
| 5,988,715 | A | * | 11/1999 | Mason | 294/19.1 |
| 6,393,646 | B1 | * | 5/2002 | Beers et al. | 15/144.4 |
| 2001/0025393 | A1 | * | 10/2001 | Nicolette | 15/105 |

* cited by examiner

*Primary Examiner*—John Kim
*Assistant Examiner*—Laura C Cole
(74) *Attorney, Agent, or Firm*—Fulbright & Jaworski L.L.P.

(57) ABSTRACT

A gutter sweep for cleaning debris from a house gutter. The gutter sweep includes a scooping head with a blade end that is curved in a manner allowing the blade end to fit up and over a gutter. Extension poles are used with the scooping head to lengthen the reach of the scooping head. A handle end is attached to the extension poles or to the scooping head.

10 Claims, 2 Drawing Sheets

GUTTER SWEEP

BACKGROUND OF THE INVENTION

The present invention is that of a newly designed tool to aid in removing debris from overhead gutters. The present invention is a tool designed to scrape leaves and debris out of the gutter safely from the ground without the need for a ladder. The present invention includes a lightweight adjustable handle, an attached scooping head, and an extension pole or poles.

The handle preferably includes two ends, a first end and a second end. The first end includes a screw in extension with external threads. The second end of the handle of the present invention includes a grip end allowing a user to grip the tool. The grip end preferably includes a rubber sleeve, but the surface of the second end of the handle may be modified to assist in gripping the tool.

Extension poles of the present invention include a first end and a second end. The first end of the extension pole preferably includes a screw in extension extending from the first end and contains external male threads. The second end of the extension pole includes an insertion point for the first end of the handle of the present invention and contains internal female threads. The combined length of the extension poles and the handle of the present invention is preferably ten feet long. The length of the tool, however, may be lengthened or shortened by the addition or removal of extension poles.

The head, also referred to as the curved scoop, of the present invention preferably includes two ends a first end with a blade curved in a manner allowing it to fit up and over the top of a gutter. The curved scoop also has a second end including an insertion point to fixedly attach either the handle or an extension pole. The user of the tool may run the blade across the bottom of the gutter thereby removing debris and other objects from the gutter.

The material used for the handle, blade and extension poles are preferably made from light-weight material. The handle and poles can be made from PVC, wood, aluminum, plastics, composite materials or other sturdy material. The blade is preferably made from metal, but may be made from other strong material so that the blade will not break while in use. Such material may be plastics, metals, composite material, and other strong material.

The present invention may also include a brush head attachment in an alternative embodiment, allowing the gutter to be scrubbed. The scoop may include bristles projecting from the surface of the scoop to allow cleaning of the gutter.

In use, the user would simply stick the curved metal blade of the present invention into the overhead gutter with the use of the ten foot handle, and pull it along so as to drag the leaves and debris into a pile. When a fair amount of debris is collected, the user would simply flip the debris up and over the top of the gutter by twisting the blade sideways. This process would be repeated as the user walks along the gutter until the entire length of the gutter has been cleaned out. If the user is cleaning gutters on a two story house, the optional extension handle would be screwed into place, effectively doubling the length of the handle. Use of the present invention would provide a very practical and convenient method of allowing anyone to quickly and easily clean overhead gutters, in a much faster and safer manner, as the use of a ladder would not be required. The present invention would greatly reduce the time required for this chore, and would be a welcome addition to every home having gutters which must be periodically cleaned of leaves and debris. Use of the present invention allows a person to clean their gutters much easier, faster, and safer, as the task could be completed from the ground without need for a ladder.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

While only the preferred form of the invention is shown, it should be understood that various changes or modifications may be made within the scope of the claims attached hereto without departing from the spirit of the invention.

DETAILED DESCRIPTION OF THE INVENTION

Figure 1:
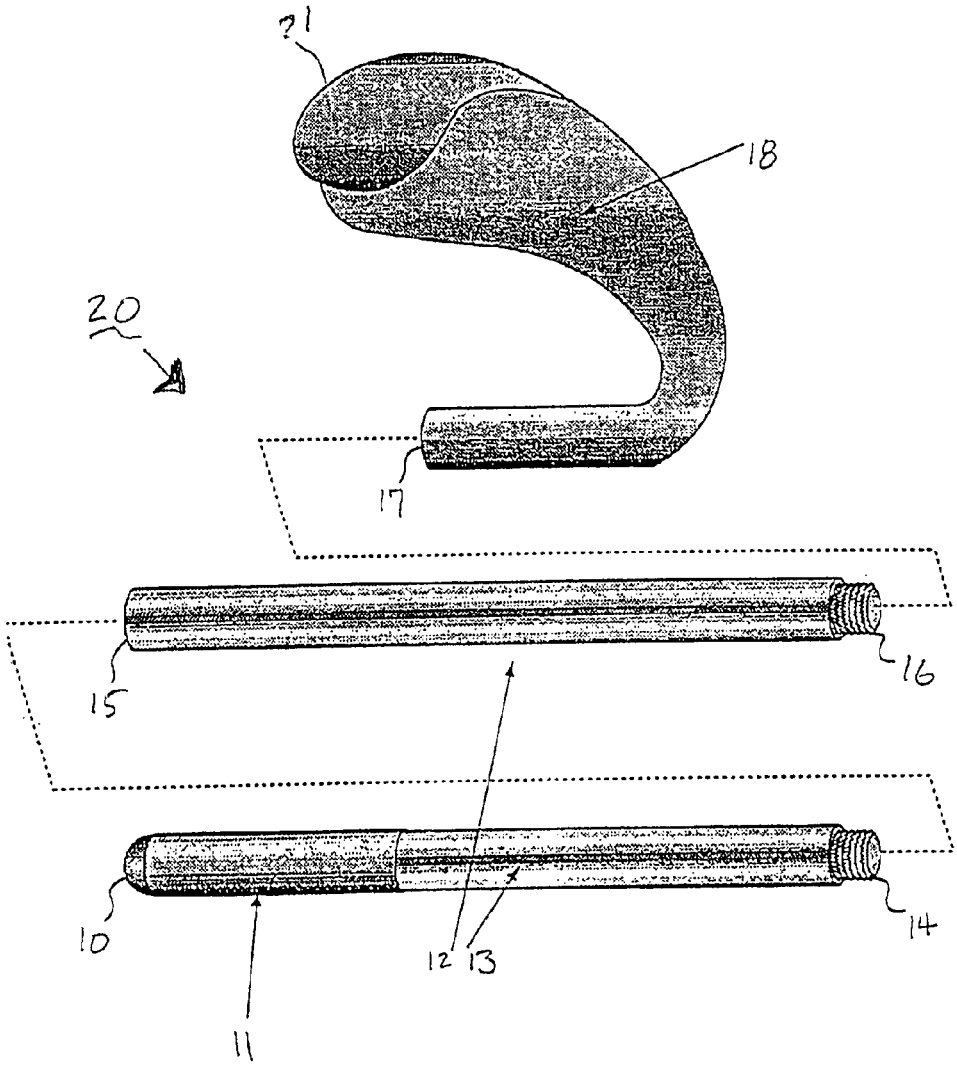
FIG. 1 is a perspective view of the gutter sweep.

Referring to FIG. 1, a perspective view of the inventive gutter scoop 20 is shown. A scooping head 18 including a blade end 21 and a head attachment end 17 is detachably affixed to an extension poles or poles 12 or the handle 13. The extension pole has two attachment ends 15, 16. Two attachment poles 12 may be placed together by attaching the attachment end 15 of one attachment pole to the attachment end 16 of another attachment pole. The attachment end 16 may be detachably affixed to the scooping head 18 to the head attachment end 17. The attachment pole 12 may be detachably affixed to the handle 13 by attaching the handle attachment end 14 to the attachment pole end 15. The handle preferably has a grip 11 covering the griping end 10 of the handle 13. The handle attachment end 14 may be detachably affixed to the scooping head 18 to the head attachment end 17. The attachment end preferably includes a male/female screw type connection. However, other connections means may be used such that the component pieces remained affixed to one another while in use and thereafter being detachable from one another. In an alternative embodiment, the present invention may be comprised of a single tool where no detachable component pieces exist. In other words, the embodiment would include a scooping had permanently fixed to an attachment pole and the pole would have a grip or gripping surface.

Figure 2:
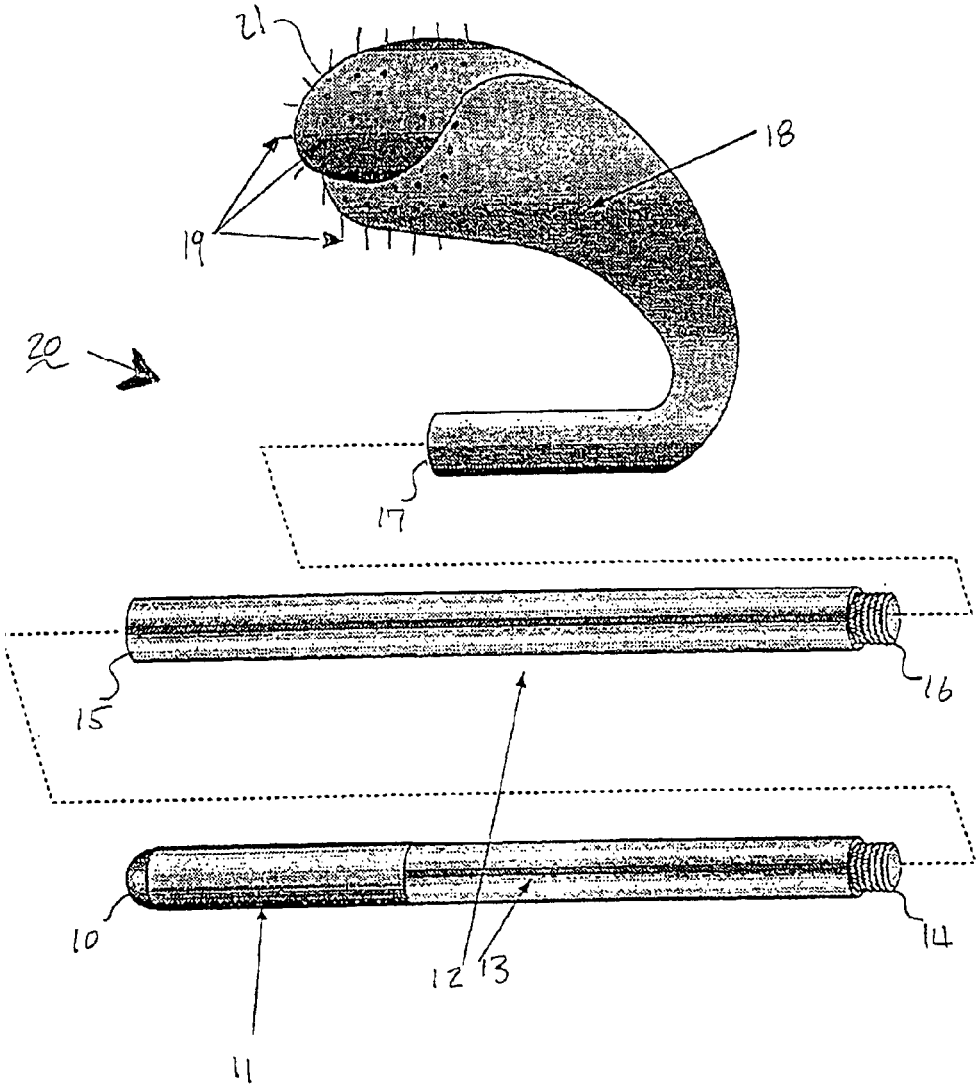
FIG. 2 is a perspective view of an alternative embodiment of the gutter sweep with cleaning bristles.

Referring to FIG. 2, a perspective view of an alternative embodiment of the gutter sweep 20 with cleaning bristles is shown 19 on the scooping head 18.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A gutter sweep for cleaning debris from a house gutter, said gutter sweep comprising:

a scooping head comprising a blade end having a curved tip and curved edges, a concave face and a convex back, said blade end defining an elongated scoop having a substantially longitudinal axis extending along the concave face and convex back, and the blade end terminating in a plane substantially perpendicular to the longitudinal axis, and a head attachment end having a longitudinal axis, said head attachment longitudinal axis being substantially parallel to said blade end longitudinal axis;

a handle having a gripping end and a handle attachment end, said handle attachment end and said blade end connected in a manner allowing said blade end to fit up over a gutter; and one or more attachment poles, each pole having a pole attachment ends;

wherein the curved tip is configured to contact said gutter to scoop debris from said gutter while said blade end is dragged along the gutter, wherein a portion of the head attachment end being opposed from a portion of said convex back, and said blade end and head attachment end are integrally formed, and wherein the head attachment longitudinal axis and the blade end longitudinal axis form a plane, the concave face configured to be open substantially perpendicular to said plane.

2. The gutter sweep of claim 1, wherein said scooping head has a plurality of cleaning bristles positioned on said blade end.

3. The gutter sweep of claim 1, further comprising a rubber grip attached to said handle gripping end.

4. The gutter sweep of claim 1, wherein said attachments poles are composed of material from the group consisting of wood, plastic, metal, composite material, or a combination thereof.

5. The gutter sweep of claim 1, wherein said scooping head is composed of material from the group consisting of wood, plastic, metal, composite material, or a combination thereof.

6. A gutter sweep for cleaning debris from house gutters, said gutter sweep comprising:

a scooping head comprising a blade end having a curved tip and curved edges, concave face and a convex back, said blade end defining an elongated scoop having a longitudinal axis extending along the concave face and convex back, and the blade end terminating in a plane substantially perpendicular to the longitudinal axis, and a head attachment end having a longitudinal axis, said head attachment longitudinal axis substantially parallel to said blade end longitudinal axis;

an attachment pole having a first pole attachment end and a second pole attachment end, said first pole attachment end being detachably affixed to said head attachment end;

a handle having a gripping end and a handle attachment end, said handle attachment end detachably affixed to said second pole attachment end, said handle attachment end and said blade end connected in a manner allowing said blade end to fit up and over a gutter;

wherein the curved tip is configured to contact said gutter to scoop debris from said gutter while said blade end is dragged along the gutter, wherein a portion of the head attachment end being opposed from a portion of said convex back, and said blade end and head attachment end are integrally formed, and wherein the head attachment longitudinal axis and the blade end longitudinal axis form a plane, the concave face configured to be open substantially perpendicular to said plane.

7. The gutter sweep of claim 6 wherein said scooping head has a plurality of cleaning bristles positioned on said blade end.

8. A gutter sweep for cleaning debris from house gutters, said gutter sweep comprising:

a scooping head comprising a blade end having a curved tip and curved edges, concave face and a convex back, said blade end defining an elongated scoop having a longitudinal axis extending along the concave face and convex back, and the blade end terminating in a plane substantially perpendicular to the longitudinal axis, and a head attachment end having a longitudinal axis, said head attachment longitudinal axis being substantially parallel to said blade end longitudinal axis; and a pole body affixed to said scooping head, wherein pole body has a gripping end, said blade end connected in a manner allowing said blade end to it up and over a gutter;

wherein the curved tip is configured to contact said gutter to scoop debris from said gutter while said blade end is dragged along the gutter, wherein a portion of the head attachment end being opposed from a portion of said convex back, and said blade end and head attachment end are integrally formed, and wherein the head attachment longitudinal axis and the blade end longitudinal axis form a plane, the concave face configured to be open substantially perpendicular to said plane;

wherein the head attachment longitudinal axis and the blade end longitudinal axis form a plane, the concave face configured to be open substantially perpendicular to said plane.

9. The gutter sweep of claim 8 wherein said scooping head has a plurality of cleaning bristles positioned on said blade end.

10. The gutter sweep of claim 8, further comprising a rubber grip attached to said handle gripping end.

* * * * *